US006118091A

United States Patent [19]

Matsumoto et al.

[11] Patent Number: 6,118,091

[45] Date of Patent: Sep. 12, 2000

[54] CIRCUIT BREAKER DEVICE

[75] Inventors: Mitsuhiro Matsumoto; Masahiro Deno, both of Shizuoka, Japan

[73] Assignee: Yazaki Corporation, Tokyo, Japan

[21] Appl. No.: 09/351,186

[22] Filed: Jul. 12, 1999

[30] Foreign Application Priority Data

Jul. 13, 1998 [JP] Japan ..... 10-197659

[51] Int. Cl.[7] ..... H01H 3/00; H01H 15/00

[52] U.S. Cl. ..... 200/293; 200/17 R; 200/16 E

[58] Field of Search ..... 200/1 R, 1 V, 200/5 R, 16 B, 16 E, 17 R, 18, 51 R, 51.01, 51.05–51.09, 51.12, 51.13, 243, 284

[56] References Cited

U.S. PATENT DOCUMENTS

| | | | |
|---|---|---|---|
| 2,641,671 | 6/1953 | Koenig et al. | 200/169 |
| 4,563,549 | 1/1986 | Lycan | 200/1 V |
| 4,639,558 | 1/1987 | Lycan | 200/1 V |
| 5,847,338 | 12/1998 | Kuki et al. | 200/17 R |

*Primary Examiner*—Michael Friedhofer
*Attorney, Agent, or Firm*—Sughrue, Mion, Zinn, Macpeak & Seas, PLLC

[57] ABSTRACT

An insulating rib (42) is provided between surfaces **(41*a*) of adjacent bus bar-receiving portions (41) of a box body (23) with which circuit terminal connection portions (25*c*) of adjacent bus bars (25) are held in contact, respectively. Each insulating rib (42) has an internal space (43) communicating with the exterior of a box body (23) of a plug box (20)**.

3 Claims, 8 Drawing Sheets

CIRCUIT BREAKER DEVICE

BACKGROUND OF INVENTION

1. Field of Invention

This invention relates a circuit breaker device for temporarily interrupting a circuit current, for example, when performing a maintenance service (such as inspection and maintenance) of an electric car, a hybrid car or the like having a high-voltage circuit for driving a motor.

2. Related Art

A conventional circuit breaker device for an electric car or the like comprises a plug box, having circuit terminals connected to open ends of an electric circuit through respective bus bars, and a plug body having short-circuit terminals fitted in and short-circuited to the respective circuit terminals of the plug box to thereby close the electric circuit.

The plug box comprises a box body having an open top (opening), and a box cover fixed to the box body to close the opening in the box body. Referring to FIG. 11, a plurality of (four in FIG. 11) bus bars 51 and 52 each in the form of a flat plate are fixedly mounted on the box body 50 in such a manner that those end portions 51*a* and 52*a* of the bus bars 51 and 52 to be connected to the open ends of the electric circuit project a predetermined amount from the box body 50.

The above conventional circuit breaker device has a problem that the pair of bus bars 51 (at the right side in FIG. 11), arranged on a straight line, can not be sufficiently insulated from the pair of bus bars 52 (at the left side in FIG. 11) arranged on a straight line.

Another problem is that heat is generated in the box body 50 by a circuit current in the electric circuit (high-voltage circuit) and other factor.

SUMMARY OF INVENTION

It is an object of this invention to provide a circuit breaker device in which a sufficient electrical insulation is achieved between bus bars received in respective bus bar-receiving portions of a plug box, and also a sufficient heat-radiating property is achieved.

The object of the present invention has been achieved by a circuit breaker device comprising:

a plug box in which circuit terminals are connected to open ends of an electric circuit through respective bus bars received respectively in a plurality of bus bar-receiving portions; and a plug body in which short-circuit terminals are fitted in and short-circuited to the circuit terminals of the plug box, respectively, thereby closing the electric circuit, and the short-circuit terminals are disengaged from the circuit terminals, respectively, thereby opening the electric circuit to interrupt a circuit current;

provided in that an insulating rib, having an internal space communicating with the exterior of the plug box, is provided between any two adjacent bus bar-receiving portions of the plug box.

In the circuit breaker device of the present invention, the circuit terminals of the plug box are connected to the open ends of the electric circuit through the respective bus bars received respectively in the plurality of bus bar-receiving portions.

In the plug body, the short-circuit terminals are fitted in and short-circuited to the circuit terminals of the plug box, respectively, thereby closing the electric circuit, and the short-circuit terminals are disengaged from the circuit terminals, respectively, thereby opening the electric circuit to interrupt the circuit current.

The insulating rib is provided between any two adjacent bus bar-receiving portions of the plug box, and insulates the bus bars, received respectively in the adjacent bus bar-receiving portions, from each other.

Each insulating rib has the internal space communicating with the exterior of the plug box, and heat due to the circuit current in the electric circuit and so on is radiated from the plug box to the exterior through the internal spaces.

DETAILED DESCRIPTION OF PREFERRED EMBODIMENTS

Figure 1:
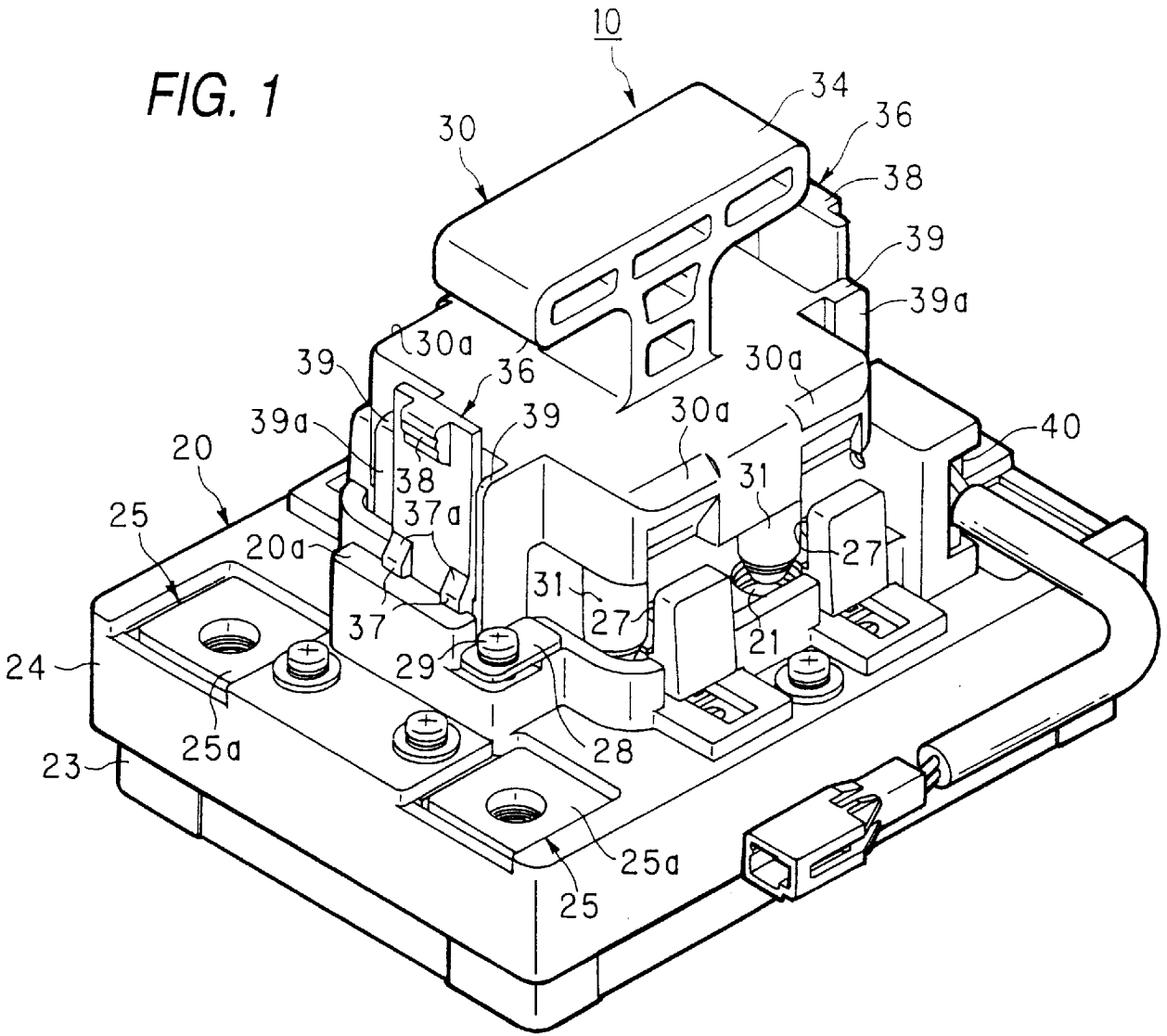
FIG. 1 is a perspective view showing the overall construction of one preferred embodiment of the present invention.
Figure 2:
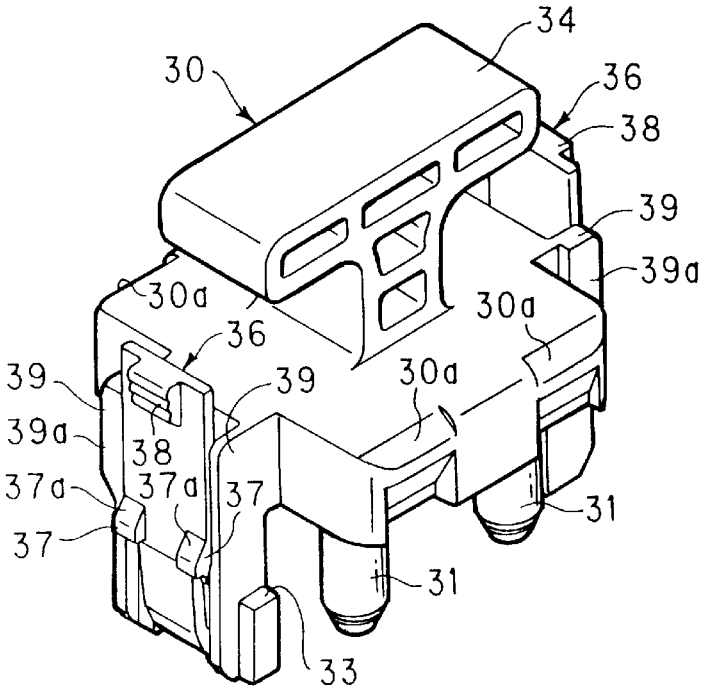
FIG. 2 is a perspective view of a plug body of a circuit breaker device.
Figure 3:
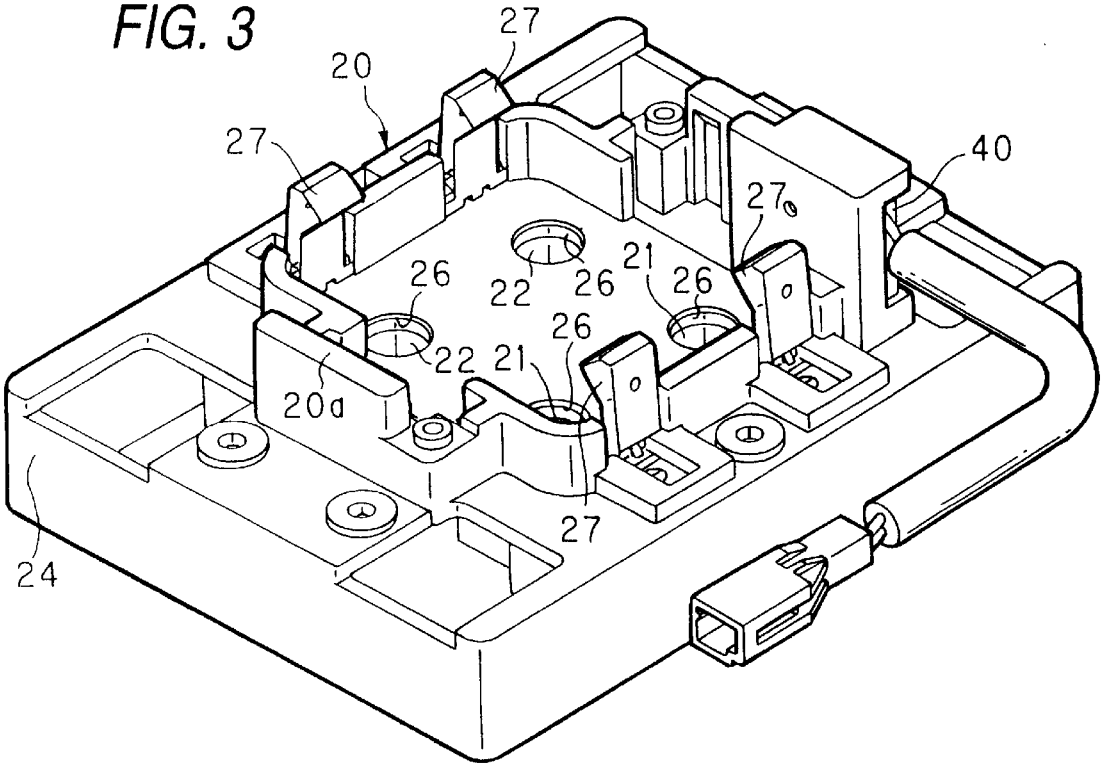
FIG. 3 is a perspective view of a box cover of a plug box.
Figure 4:
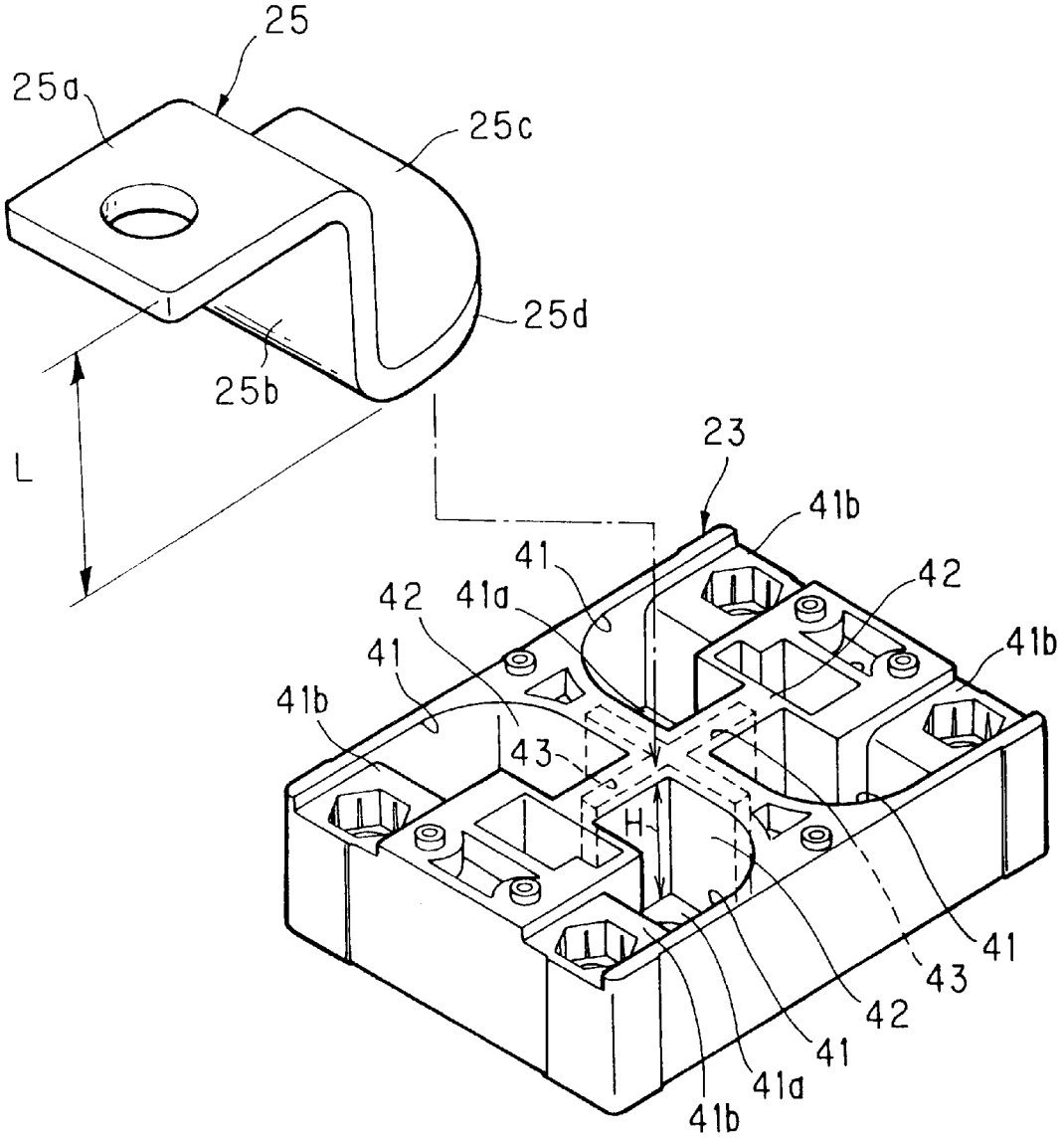
FIG. 4 is a perspective view showing a box body of the plug box, as well as a bus bar.
Figure 5:
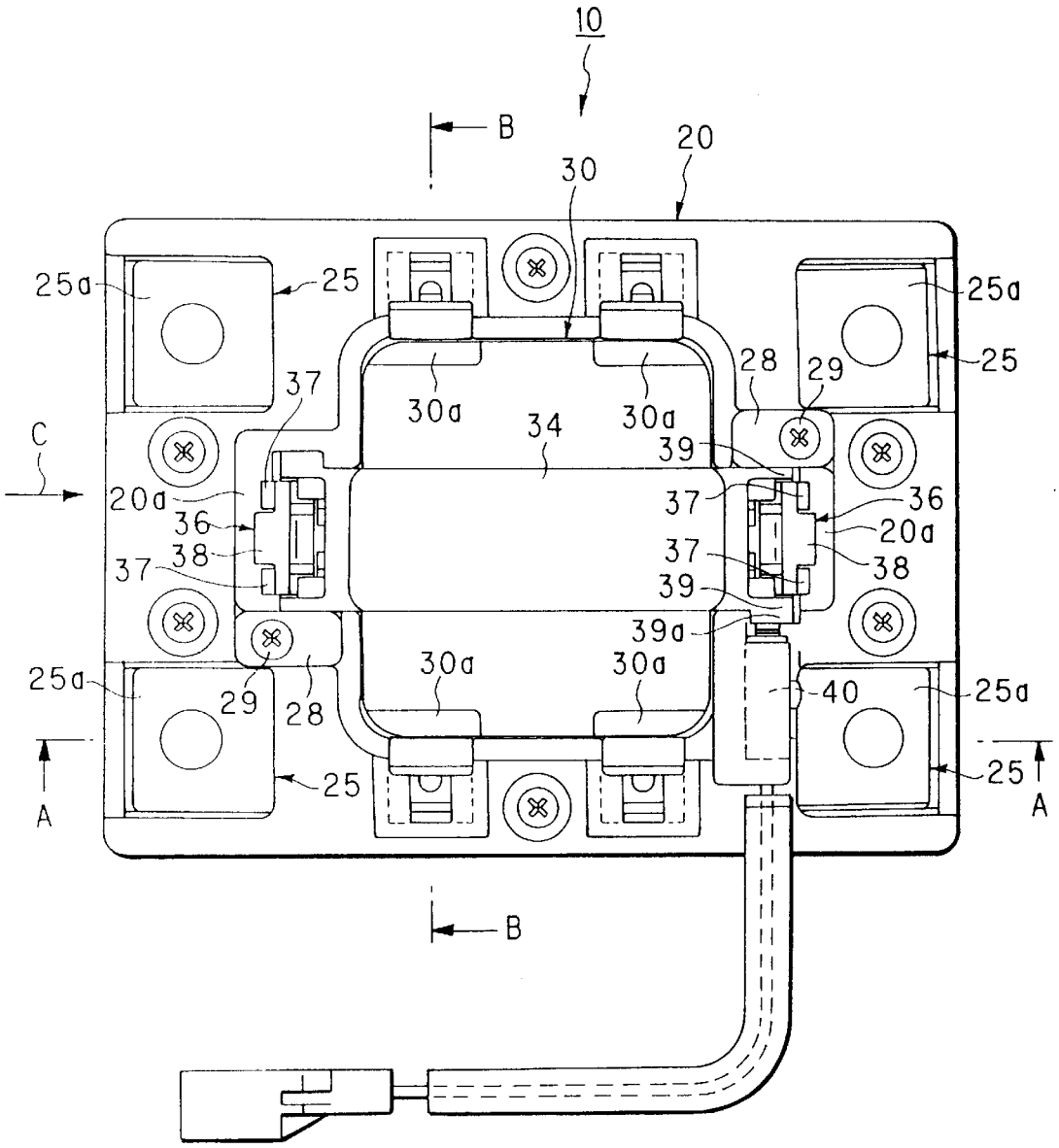
FIG. 5 is a plan view of the circuit breaker device.
Figure 6:
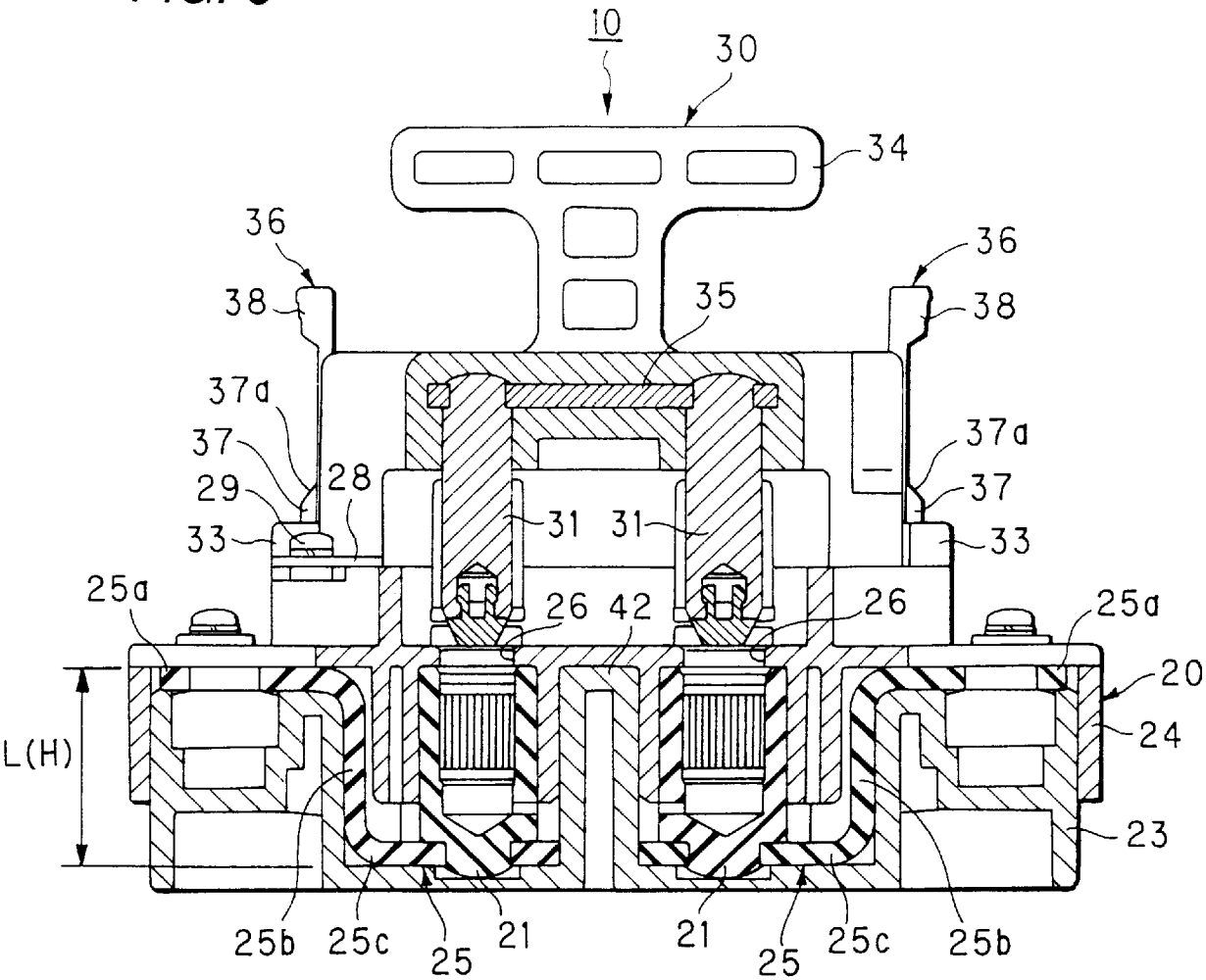
FIG. 6 is a cross-sectional view of the circuit breaker device in a provisionally-retained condition taken along the line A—A.
Figure 7:
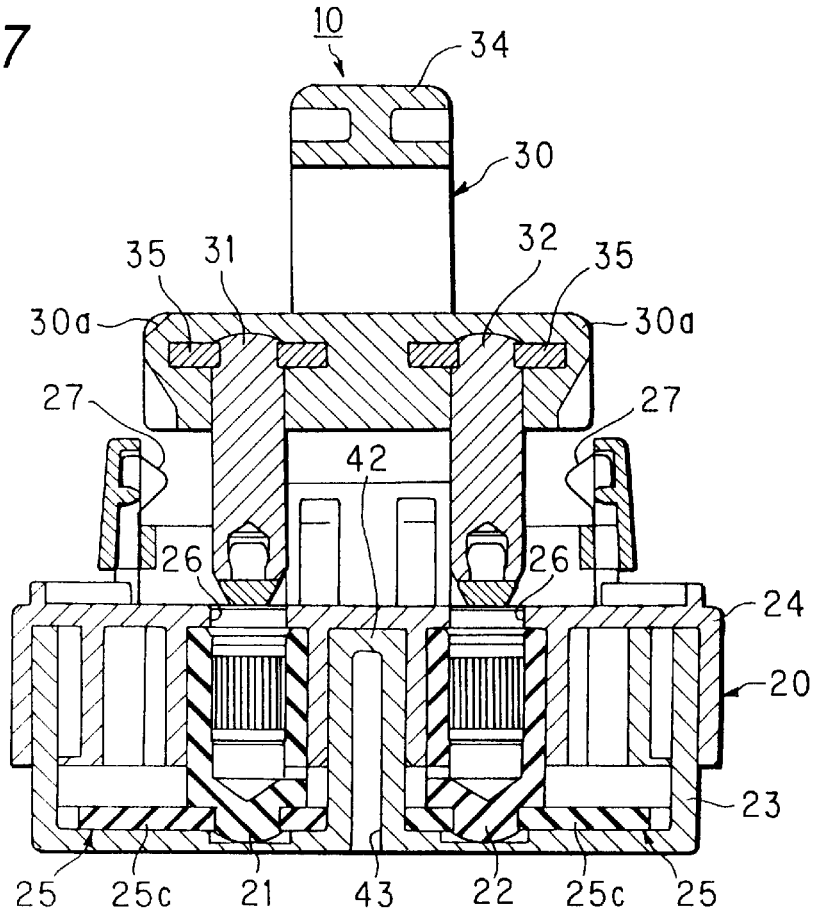
FIG. 7 is a cross-sectional view of the circuit breaker device in the provisionally-retained condition taken along the line B—B.
Figure 8:
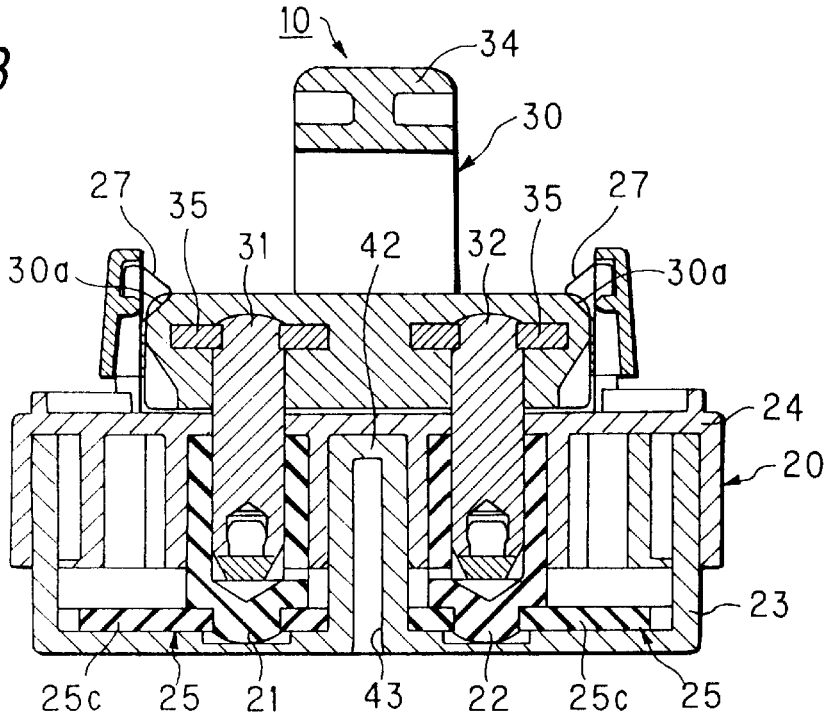
FIG. 8 is a cross-sectional view of the circuit breaker device in a completely-retained condition taken along the line B—B.
Figure 9:
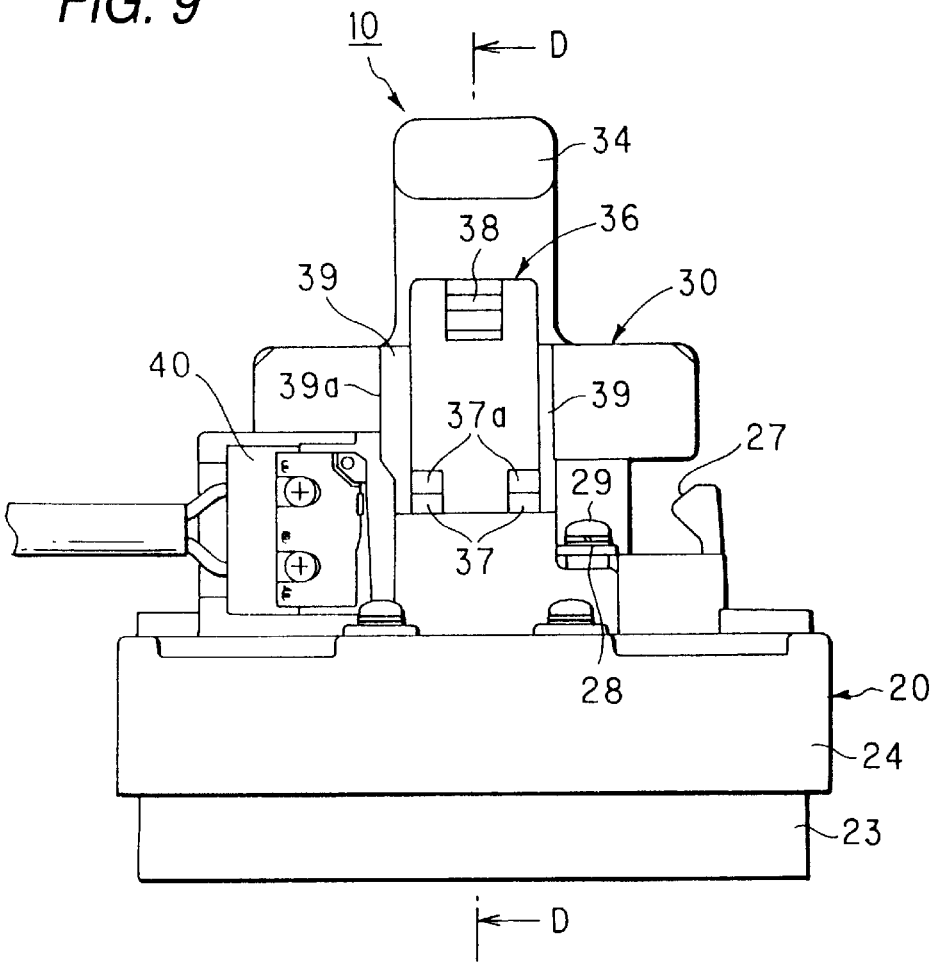
FIG. 9 is a side-elevational view of the circuit breaker device in the provisionally-retained condition as viewed in a direction of arrow C.
Figure 10:
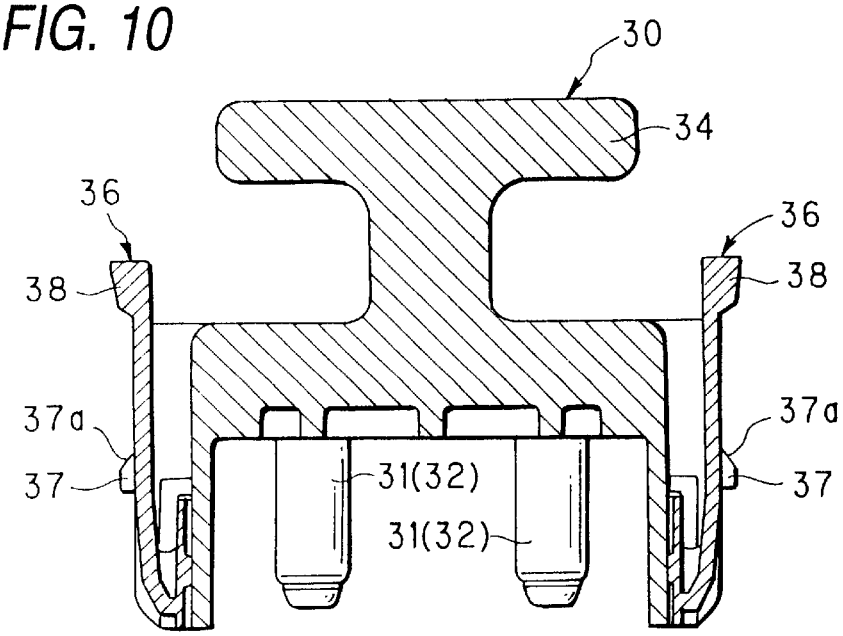
FIG. 10 is a cross-sectional view of the plug body of the circuit breaker device taken along the line D—D.
Figure 11:
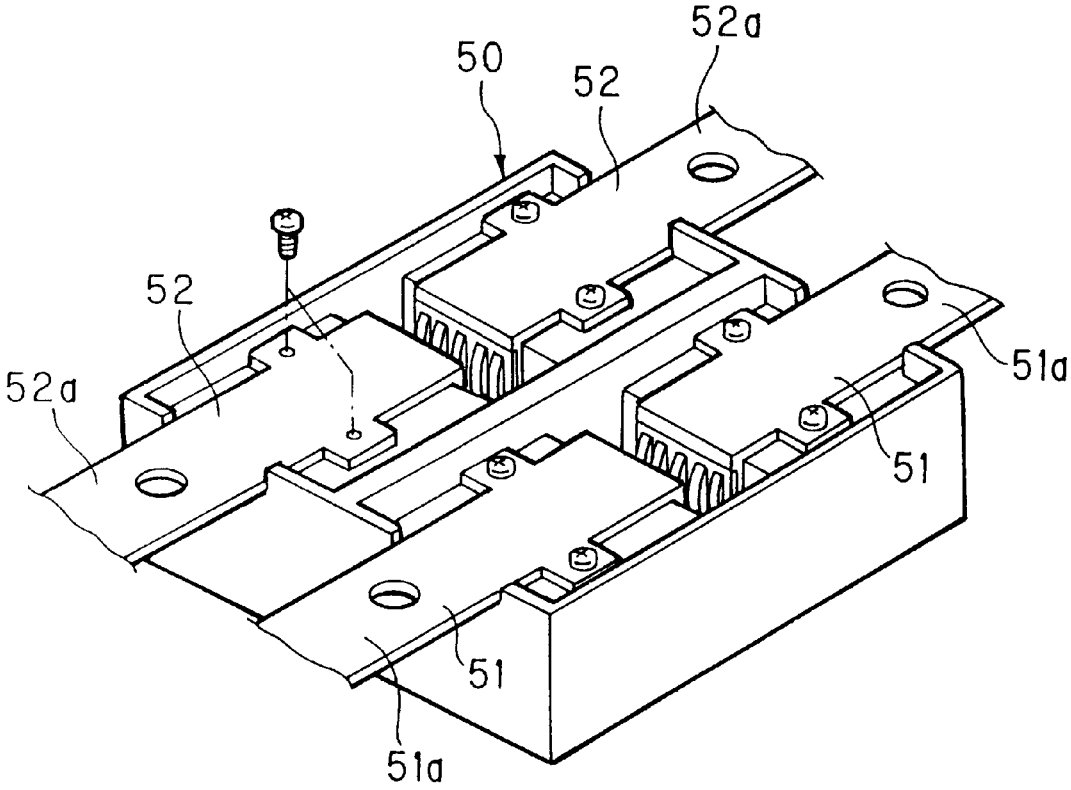
FIG. 11 PRIOR ART
FIG. 11 is a perspective view showing a plug box of a conventional circuit breaker device.

FIG. 1 is a perspective view showing the overall construction of one preferred embodiment of a circuit breaker device of the present invention in a provisionally-retained condition. FIG. 2 is a perspective view of a plug body of the circuit breaker device of FIG. 1, FIG. 3 is a perspective view of a box cover of a plug box of the circuit breaker device of FIG. 1, and FIG. 4 is a perspective view showing a box body of the plug box of the circuit breaker device of FIG. 1, as well as a bus bar. FIG. 5 is a plan view of the circuit breaker device of FIG. 1, FIG. 6 is a cross-sectional view of the circuit breaker device in the provisionally-retained condition taken along the line A—A of FIG. 5, FIG. 7 is a cross-sectional view of the circuit breaker device in the provisionally-retained condition taken along the line B—B of FIG. 5, and FIG. 8 is a cross-sectional view of the circuit breaker device in a completely-retained condition taken along the line B—B of FIG. 5. FIG. 9 is a side-elevational view of the circuit breaker device in the provisionally-retained condition as viewed in a direction of arrow C of FIG. 5, and FIG. 10 is a cross-sectional view of the plug body of the circuit breaker device taken along the line D—D of FIG. 9.

Referring to FIGS. 1 to 3, in the circuit breaker device 10, the plug box 20 has circuit terminals (female terminals) 21 and 22 connected to open ends of an electric circuit (not shown). The plug body 30, having short-circuit terminals (male terminals) 31 and 32 is mounted on the plug box 20 so as to be displaced between the provisionally-retained position (see FIG. 7) and the completely-retained position (see FIG. 8). In the completely-retained position of the plug body 30, the short-circuit terminals 31 and 32 are fitted in and short-circuited to the respective circuit terminals 21 and 22 of the plug box 20, thereby closing the electric circuit. In the provisionally-retained position, the short-circuit terminals 31 and 32 are disengaged from the respective circuit terminals 21 and 22, thereby opening the electric circuit to interrupt the circuit current.

Referring to FIGS. 1 to 8, the plug box 20 comprises the box body 23, having a plurality of (four in this embodiment) bus bar-receiving portions 41 open to a surface thereof, and the box cover 24 fixed to the box body 23 to close the bus bar-receiving portions 41. The circuit terminals 21 and 22 of the plug box 20 are connected to the open ends of the electric circuit through respective bus bars 25 (only one of which is shown in FIG. 4) received respectively in the bus bar-receiving portions 41.

The plurality of (four in this embodiment) circuit terminals 21 and 22 of a generally cylindrical shape are provided respectively at predetermined portions of the box body 23. The circuit terminals 21 and 22 are electrically connected respectively to high-voltage wires (not shown) of the electric circuit through the respective bus bars 25. The short-circuit terminals 31 and 32 on the plug body 30 are fitted respectively in the circuit terminals 21 and 22 through respective terminal insertion holes 26 formed in the box cover 24.

Referring to FIGS. 4 to 6, each of the bus bars 25 includes an electric circuit connection portion 25*a* to be connected to the open end of the electric circuit, and a circuit terminal connection portion 25*c* which is spaced a distance L from the electric circuit connection portion 25*a* in a direction of fitting of the short-circuit terminals 31 and 32 (that is, downwardly in FIG. 6) in generally parallel relation to the connection portion 25*a*, and is connected to the connection portion 25*a* through an interconnecting portion 25*b*, and is adapted to be connected to the associated circuit terminal 21, 22 on the plug box 20. The interconnecting portion 25*b* extends between and are formed integrally with the electric circuit connection portion 25*a* and the circuit terminal connection portion 25*c* in generally perpendicular relation thereto, and the interconnecting portion 25*b* interconnects the two connection portions in a predetermined manner.

A corner portion 25*d* of the circuit terminal connection portion 25*c*, disposed near to the interconnecting portion 25*b*, is chamfered.

Referring to FIGS. 4, 6 and 7, each of the bus bar-receiving portions 41 of the box body 23 corresponds in configuration to the bus bar 25.

More specifically, a surface 41*a* of each bus bar-receiving portion 41 for contact with the circuit terminal connection portion 25*c* of the bus bar 25 is spaced a distance, corresponding to the distance L (described above for the bus bar 25) from a surface 41*b* thereof for contact with the electric circuit connection portion 25*a* of the bus bar 25 in the direction of fitting of the short-circuit terminals 31 and 32 (that is, downwardly in FIG. 6).

The box body 23 has insulating ribs 42 each provided between the surfaces 41*a* of the adjacent bus bar-receiving portions 41 for contact respectively with the circuit terminal connection portions 25*c* of the bus bars 25. Each insulating rib 42 has a predetermined dimension H in the direction of fitting of the short-circuit terminals 31 and 32 (that is, in an upward-downward direction in FIG. 6).

The insulating rib 42 has an internal space 43 communicating with the exterior of the box body 23 of the plug box 20 (In this embodiment, the internal space 43 is open to the bottom or lower surface of the box body 23).

The internal space 43 of the insulating rib 42 may be open to the upper surface of the box body 23, or may be open both to the upper and lower surfaces of the box body 23.

The electric circuit connection portion 25*a* and the circuit terminal connection portion 25*c* of each bus bar 25 are spaced a distance L from each other in the upward-downward direction (FIG. 6), and the configuration of each bus bar-receiving portion 41 of the box body 23 corresponds to the configuration of the bus bar 25, and the insulating rib 42 is provided between the adjacent bus bar-receiving portions 41 of the box body 23. With this construction, the distance between the circuit terminal connection portions 25*c* of the adjacent bus bars 25 for insulating purposes is the sum of a horizontal distance (FIG. 6) (corresponding to the thickness W of the insulating rib 42) between the circuit terminal connection portions 25*c* of the adjacent bus bars 25 and a vertical distance (FIG. 6) (corresponding to H×2 where H represents the dimension of the insulating rib 42) between the adjacent terminal connection portions 25*c*.

Referring again to FIGS. 1 to 8, two pairs of right and left (FIG. 8) completely-retaining springs 27 are provided at the upper surface of the box cover 24, and each pair of right and left springs 27 are disposed adjacent to right and left (FIG. 8) ends of the box cover 24, respectively.

The completely-retaining springs 27 are engaged respectively with spring engagement surfaces 30*a* (at upper edge portions in FIG. 8) of the plug body 30 in the completely-retained position, and hold the plug body 30 in the completely-retained position by their resilient force.

A pair of plug body-retaining plates 28 are fixedly secured to the upper surface (FIG. 6) of the box cover 24 by respective screws 29, and are disposed on a diagonal line, with the center of the box cover 24 lying therebetween as viewed from the top (see FIG. 5). The plug body-retaining plates 28 are engaged respectively with provisionally-retaining step portions 33, formed on the plug body 30, in the provisionally-retained position, thereby preventing the plug body 30 from being displaced beyond the provisionally-retained position in a direction away from the plug box 20.

Referring to FIGS. 1 to 10, the plug body 30 can be displaced relative to the plug box 20 between the provisionally-retained position (shown in FIG. 7) where the short-circuit terminals 31 and 32 are disengaged respectively from the circuit terminals 21 and 22 and the completely-retained position (shown in FIG. 8) where the short-circuit terminals 31 and 32 are fitted respectively in the circuit terminals 21 and 22. The plug body 30 can be displaced between the provisionally-retained position and the completely-retained position by manually operating an operating lever 34 of a generally T-shape formed integrally with the plug body 30.

The short-circuit terminals 31 and 32 project from the lower surface (FIG. 2) of the plug body 30, and are so arranged as to be opposed respectively to the circuit terminals 21 and 22. The number of the short-circuit terminals 31 and 32 is equal to the number of the circuit terminals 21 and 22, and is four in this embodiment. Each of the short-circuit terminals 31 and 32 has a generally cylindrical shape so as to be fitted in the associated circuit terminal 21, 22. Among the short-circuit terminals 31 and 32, the short-circuit terminals 31, arranged right and left in FIG. 6, are electrically connected together by a bus bar 35.

A pair of elastic lock arms 36 are provided respectively on right and left (opposite) side surfaces (FIG. 10) of the plug body 30. The lock arms 36 are made of a material different from that of the plug body 30, and are provided as separate parts. More specifically, a material, having a good heat resistance, is selected for the plug body 30 while a material, having excellent heat resistance and elasticity, is selected for the lock arms 36.

A pair of provisionally-retaining projections 37 are formed on each lock arm 36, and are disposed generally centrally of a length thereof. A slanting surface 37*a* is formed on an upper surface (FIG. 10) of each provisionally-retaining projection 37, and the thickness (dimension in the right-left direction in FIG. 10) of the provisionally-retaining projection 37 is increasing progressively downward (FIG. 10).

A grip portion 38 is formed at the upper end (FIG. 10) of each lock arm 36, and is disposed at a predetermined position relative to the operating lever 34 so that the grip portions 38 can be held respectively by the fingers of the hand operating or pressing the operating lever 34.

When the operating lever 34 is to be manually operated or pressed so as to displace the plug body 30 from the provisionally-retained position to the completely-retained position, the grip portions 38 are gripped respectively by the fingers of the hand, operating the operating lever 34, from the right and left sides (FIG. 10). When the grip portions 38 are thus gripped by the fingers, the lock arms 36 are elastically deformed to be turned about their respective lower ends toward the center of the plug body.

Namely, in the provisionally-retained position of the plug body 30, the provisionally-retaining projections 37 of each lock arm 36 are engaged with a corresponding provisionally-retaining projection engagement surface 20a of the plug box 20, thereby holding the plug body 30 in the provisionally-retained position.

When the plug body 30 is to be manually displaced from the provisionally-retained position to the completely-retained position, the grip portions 38 of the lock arms 36 are gripped by the fingers of the hand from the right and left sides (FIG. 10) so as to elastically deform the lock arms 36 toward the center of the plug body 30. As a result, the provisionally-retaining projections 37 of each lock arm 36 are disengaged from the associated provisionally-retaining projection engagement surface 20*a* of the plug box 20, thereby allowing the displacement of the plug body 30 into the completely-retained position.

When the plug body 30 is to be manually displaced from the completely-retained position again to the provisionally-retained position, the slanting surfaces 37*a* of the provisionally-retaining projections 37 of each lock arm 36 slide relative to the plug box 20, thereby allowing the displacement of the plug body 30 into the provisionally-retained position.

A pair of guide ribs 39 for each lock arm 36 are formed on the plug body 30, and are disposed adjacent respectively to the opposite (right and left in FIG. 9) side edges of the lock arm 36, and these guide ribs 39 protect the lock arm 36 from an external force and so on. The guide ribs 39 are made of a rigid material, and project outwardly slightly beyond the outer surface of the lock arm 36.

The left guide rib 39 (FIG. 9) has a bulge portion 39*a* of a predetermined shape projecting left (FIG. 9) a predetermined amount therefrom. In accordance with the displacement of the plug body 30, the bulge portion 39 is brought into and out of contact with a microswitch 40 fixedly mounted on the plug box 20, thereby turning on and off the microswitch 40.

Namely, in the provisionally-retained position of the plug body 30, the bulge portion 39*a* is held out of contact with the microswitch 40, thereby holding the microswitch 40 in the OFF state. In the completely-retained position of the plug body 30, the bulge portion 39*a* is held in contact with the microswitch 40 to turn on the microswitch 40. Thus, the microswitch 40 detects the displacement of the plug body 30 into the completely-retained position (that is, the fitting of the short-circuit terminals 31 and 32 into the respective circuit terminals 21 and 22).

The operation of this embodiment will now be described.

When performing a maintenance service, the operator pulls the operating lever 34 of the plug body 30 with the hand in a direction away from the plug box 20 (that is, upwardly in FIG. 8), thereby displacing the plug body 30 from the completely-retained position to the provisionally-retained position with one action while flexing the completely-retaining springs 27. As a result, the electric circuit is opened, so that the circuit current is interrupted.

At this time, the plug body-retaining plates 28 are brought into engagement with the provisionally-retaining step portions 33, respectively, thereby preventing the plug body 30 from being displaced beyond the provisionally-retained position in a direction away from the plug box 20. At the same time, the provisionally-retaining projections 37 of each lock arm 36 are brought into engagement with the provisionally-retaining projection engagement surface 20*a* of the plug box 20. Therefore, the plug body 30 is positively held in the provisionally-retained position, thereby positively preventing the erroneous fitting of the short-circuit terminals 31 and 32 in the circuit terminals 21 and 22, and so on.

For displacing the plug body 30 from the provisionally-retained position to the completely-retained position after the maintenance service is performed, the operator grips the grip portions 38 of the lock arms 36 with the fingers of the hand, operating the operating lever 34, to elastically deform the lock arms 36, and operates or presses the operating lever 34 of the plug body 30 (two actions). As a result, the plug body 30 is displaced into the completely-retained position while flexing the completely-retaining springs 27, and is held in this completely-retained position by the resilient forces of the completely-retaining springs 27.

The insulating rib 42, provided between the adjacent bus bar-receiving portions 41 of the box body 23 of the plug box 20, has the dimension H in the direction of fitting of the short-circuit terminals 31 and 32, so that the vertical distance (FIG. 6) is increased, and therefore a high insulation is secured between the circuit terminal connection portions 25*c* of the adjacent bus bars 25 without increasing the horizontal distance (FIG. 6) between these circuit terminal connection portions 25*c*, that is, without increasing the outer size of the box body 23 of the plug box 20.

Each insulating rib 42 has the internal space 43 communicating with the exterior of the box body 23 of the plug box 20, and therefore heat, generated in the plug box 20 by the circuit current in the electric circuit or other factor, is radiated from the plug box 20 to the exterior through the internal spaces 43.

In the above embodiment, the insulating rib 42, having the internal space 43 communicating with the exterior of the box body 23 of the plug box 20, is provided between the surfaces 41*a* of the adjacent bus bar-receiving portions 41 of the box body 23 of the plug box 20 with which the circuit terminal connection portions 25*c* of the adjacent bus bars 25 are held in contact, respectively.

Therefore, because of the provision of the insulating ribs 42, a high insulation can be secured between the circuit terminal connection portions 25*c* of the adjacent bus bars 25 while achieving the compact design of the box body.

And besides, heat, generated in the plug box 20 by the circuit current in the electric circuit and other factor, can be radiated from the plug box 20 to the exterior through the internal spaces 43 of the insulating ribs 42.

As described above, in the present invention, the insulating rib, having the internal space communicating with the exterior of the plug box, is provided between any two adjacent bus bar-receiving portions of the plug box. Therefore, a sufficient insulation can be secured between the bus bars received respectively in the adjacent bus bar-receiving portions of the plug box, and also heat due to the circuit current in the electric circuit and so on can be radiated from the plug box to the exterior.

What is claimed is:

1. A circuit breaker device comprising:

a plug box in which circuit terminals are connected to open ends of an electric circuit through respective bus bars received respectively in a plurality of bus bar-receiving portions;

a plug body in which short-circuit terminals are fitted in and short-circuited to said circuit terminals of said plug box, respectively, to close said electric circuit, and said short-circuit terminals being disengaged from said circuit terminals, respectively, to open said electric circuit to interrupt a circuit current; and an insulating rib, having an internal space communicating with the exterior of said plug box, is provided between any two adjacent bus bar-receiving portions of said plug box.

2. A circuit breaker device comprising:

a plug box having a plurality of bus bar-receiving portions and circuit terminals connected to open ends of an electric circuit through bus bars received in said plurality of bus bar-receiving portions;

a plug body in which short-circuit terminals are fitted in and short-circuited to said circuit terminals are fitted in and short-circuited to said electric circuit, and said short-circuit terminals being disengagable from said circuit terminals, to open said electric circuit to interrupt a circuit current; and an insulating rib provided between adjacent bus bar-receiving portions to insulate bus bars received in said bus bar-receiving portions, wherein said insulating rib has an internal space communicating with the exterior of said plug box to dissipate heat generated inside said plug box.

3. The circuit breaker device according to claim 2, wherein a shape of said bus bar-receiving portions corresponds to a shape of the bus bars received therein, wherein the bus bars are shaped so as to have a circuit terminal connection portion which connects to the circuit terminal and an electric circuit connection portion for connecting to an open end of the electric circuit, said circuit terminal connection portion being disposed at a predetermined vertical distance from said electric circuit connection portion, and wherein said insulating rib has a height at least the same as said predetermined vertical height, so as to insulate said bus bars from each other along the height thereof.

* * * * *